United States Patent [19]

Haertl

[11] Patent Number: 4,987,597

[45] Date of Patent: Jan. 22, 1991

[54] APPARATUS FOR CLOSING OPENINGS OF A HEATING AID OR AN EAR ADAPTOR FOR HEARING AIDS

[75] Inventor: Christof Haertl, Neunkirchen, Fed. Rep. of Germany

[73] Assignee: Siemens Aktiengesellschaft, Berlin & Munich, Fed. Rep. of Germany

[21] Appl. No.: 251,857

[22] Filed: Oct. 3, 1988

[30] Foreign Application Priority Data

Oct. 5, 1987 [DE] Fed. Rep. of Germany ..... 8713369

[51] Int. Cl.[5] ..... H04R 25/00

[52] U.S. Cl. ..... 381/69

[58] Field of Search ..... 381/69, 68.6, 189; 181/129, 130, 135

[56] References Cited

U.S. PATENT DOCUMENTS

| | | | |
|---|---|---|---|
| Re. 26,174 | 3/1967 | Leale | 381/68.6 |
| 3,170,046 | 2/1965 | Leale | 381/68.6 |
| 3,197,577 | 7/1965 | Kuklock | 381/68.6 |
| 3,408,461 | 10/1968 | Langford | 381/68.6 |
| 3,842,829 | 10/1974 | Ellis | 128/868 |
| 3,906,170 | 9/1975 | Guice | 381/69 |
| 3,963,881 | 6/1976 | Fraim et al. | 381/155 |
| 3,976,848 | 8/1976 | Estes | 381/69 |
| 3,987,258 | 10/1976 | Tsutsui et al. | 381/189 |
| 4,002,168 | 1/1977 | Petterson | 604/298 |
| 4,073,366 | 2/1978 | Estes | 381/94 |
| 4,125,822 | 11/1978 | Perren et al. | 338/34 |
| 4,447,677 | 5/1984 | Miyahra et al. | 381/68.7 |
| 4,520,236 | 5/1985 | Gauthier | 381/68.6 |
| 4,553,627 | 11/1985 | Gastmeier et al. | 381/68.6 |
| 4,679,650 | 7/1987 | Moser et al. | 181/130 |
| 4,716,985 | 1/1988 | Haertl | 381/69 |
| 4,739,512 | 4/1988 | Hartl et al. | 381/69 |

FOREIGN PATENT DOCUMENTS

| | | | |
|---|---|---|---|
| 567740 | 4/1958 | Belgium | 181/130 |
| 0160473 | 11/1985 | European Pat. Off. . | |
| 1951165 | 4/1966 | Fed. Rep. of Germany . | |
| 1263849 | 3/1968 | Fed. Rep. of Germany . | |
| 1270616 | 6/1968 | Fed. Rep. of Germany | 381/68.6 |
| 8436783 | 5/1986 | Fed. Rep. of Germany . | |
| 8504765.1 | 7/1986 | Fed. Rep. of Germany . | |
| 3540579 | 5/1987 | Fed. Rep. of Germany | 381/6 |
| 2155276 | 9/1985 | United Kingdom . | |

*Primary Examiner*—Forester W. Isen

*Attorney, Agent, or Firm*—Hill, Van Santen, Steadman & Simpson

[57] ABSTRACT

An apparatus for closing an opening of a hearing aid or an ear adaptor for a hearing aid, particularly openings such as sound entry openings, sound exit openings and aeration openings utilizes a micro-porous membrane of an anti-adhesive material which is introduced into the respective opening. Preferably, the membrane is polytetrafluoroethylene material.

4 Claims, 2 Drawing Sheets

APPARATUS FOR CLOSING OPENINGS OF A HEATING AID OR AN EAR ADAPTOR FOR HEARING AIDS

BACKGROUND OF THE INVENTION

The present invention is directed to an apparatus for closing openings of a hearing aid or ear adaptor for hearing aids.

German Gebrauchsmuster No. 19 51 165 discloses an in-the-ear hearing aid, wherein a cylindrical member can be placed on a sound exit nozzle. The interior of this member has a chamber-like expansion of a bore in which a layer of porous, sound-permeable material is arranged. The sound proceeding from the earphone of the hearing aid into the bore can, thus, easily pass the layer of porous material. Earwax, or cerumen, that is secreted inside of the auditory channel or canal, however, cannot proceed into the inside of the hearing aid in the reverse direction, due to this porous layer of material.

Over and above the disclosures of the above-mentioned German Gebrauchsmuster, German Gebrauchsmusters No. 84 36 783 and 85 04 765 both disclose perforated caps that can be attached to a sound exit nozzle, either directly in an in-the-ear hearing aid or in an ear adaptor of a behind-the-ear hearing aid, which adaptor can then be introduced into the ear, for example by being pluggable or screwable therein. The perforated caps guarantee unimpeded sound exit. Earwax that is secreted in the auditory channel or canal is largely kept out by the openings, since relatively long creeping distances are present due to the formation of niches therein.

The solutions presented in the above-mentioned prior art for preventing earwax from creeping in, however, still is relatively undesirable. At the very least, the protective devices must be replaced or cleaned relatively frequently. Another disadvantage in these proposed solutions is that there is no protection against the penetration of moisture, particularly perspiration which will occur in the interior of the auditory channel and move in the direction of the earphone. Keeping out perspiration or sweat is of particular significance, especially given the in-the-ear hearing aids, because the path from the sound exit location to the earphone is relatively short and, as experience has taught, the extremely aggressive or salty sweat will quickly damage the earphone. However, such a protection is also needed, given behind-the-ear hearing aids, since damage to the earphone occurs over and over despite the relatively long path to the earphone.

SUMMARY OF THE INVENTION

The object of the present invention is to provide an apparatus for closing an opening in an earphone for a hearing aid or the like, which is simpler to clean to remove contamination, such as earwax, and which simultaneously prevents moisture, particularly perspiration, from the auditory channel or ear canal from proceeding through the respective openings and into the hearing aid.

To accomplish these objects, the present invention is directed to an apparatus for closing openings for an ear adaptor for hearing aids, in particularly the openings for sound entry and/or sound exit, or for aeration. The apparatus comprises a micro-porous membrane of anti-adhesive or anti-adherent material, which is hydrophobic and is introducible into the respective opening.

A micro-porous membrane of an anti-adhesive or an anti-adhesive adherent material will prevent both the penetration of the earwax, because of the extremely small pores, and of moisture, particularly sweat, into the interior of the hearing aid because of the formation of the membrane of the anti-adhesive material or hydrophobic material. A hydrophobic material, namely, does not allow drops of sweat to become flat so that the drops can, likewise, not penetrate into the micro-pores. Due to the anti-adhering effect, however, the coating of earwax that has attached to the membrane can also be more easily removed than herebefore, for example with the assistance of ultrasonic cleaning.

A preferred development utilizes a micro-porous membrane which is composed of polytetrafluorethylene. A membrane of such a material is proven particularly suitable for the present purposes.

Other advantages and details of the invention will be readily apparent from the following description of the preferred embodiments with reference to the drawings and claims.

DESCRIPTION OF THE PREFERRED EMBODIMENTS

Figure 1:
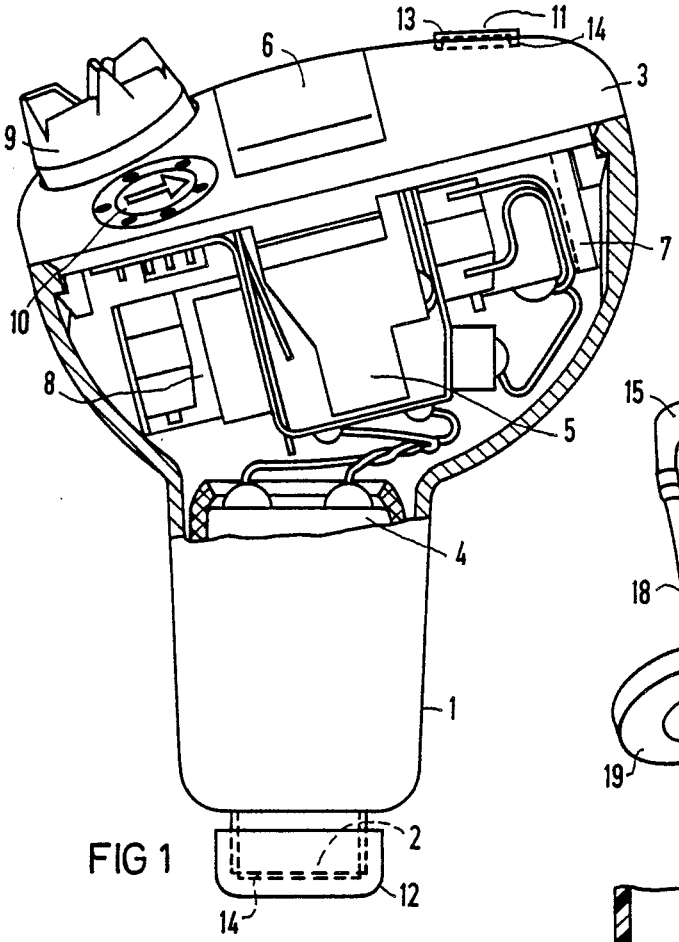
FIG. 1 is a side view with portions broken away for purposes of illustration of an in-the-ear hearing aid utilizing the present invention.

The principles of the present invention are particularly useful for an in-the-ear hearing aid, illustrated in FIG. 1. The hearing aid has a housing 1 which has a sound exit nozzle 2 at one end and is covered at the opposite end by a end cover 3. An earphone 4 that has its output side connected to the sound exit nozzle 2 is partially shown in the cut-away housing of FIG. 1. The housing also has a battery compartment 5, which is illustrated without the battery being inserted therein and which compartment can be swivelled out of the hearing aid through a door or a hatch 6 in the end cover 3. The hearing aid housing, in addition, includes a microphone 7 and an amplifier electronics 8. On the cover 3 is a rotary knob 9 for setting the volume and a matching actuator 10.

The cover 3 has a sound entrance opening 11, which is covered by a cap 13 which, preferably, is constructed in accordance with the present invention. The nozzle 2 is illustrated as being covered or closed by a screwable cap 12, whereas the cap 13, as illustrated, is a snap-in-type cap, which is seated in the sound entry opening 11.

Both the caps 12 and 13 each have a micro-porous polytetrafluorethylene membrane 14, which membrane material is commercially available under the registered Trademark GORE-TEX. This membrane forms means for sealing the respective openings against earwax and sweat, which are both secreted in the auditory or ear canal. The membrane 14, respectively, however, is extremely transmissive for the sound respectively emerging or, respectively, entering the hearing aid. Various embodiments of the cap are shown in FIGS. 4–17 and shall be set forth in greater detail. The polytetraflourethylene membrane, which are sold by W. L. Gore & Associates, Inc., Newark, Del., U.S.A., are described, for example, in the perspectus "GORE-TEX PTFE Membranes and Laminates", 1986, W. L. Gore & Co. GmbH, D-8011 Putzbrunn and also in the European Published Patent Application No. 0160,473. G0RE-TEX® expanded PTFE is chemically inert and not affected by any common chemical. It has a low friction coefficient, functions within a wide temperature range, does not age, and is weather durable. It is also porous, air permeable, extremely strong, hydrophobic, and biocompatible.

Figure 2:
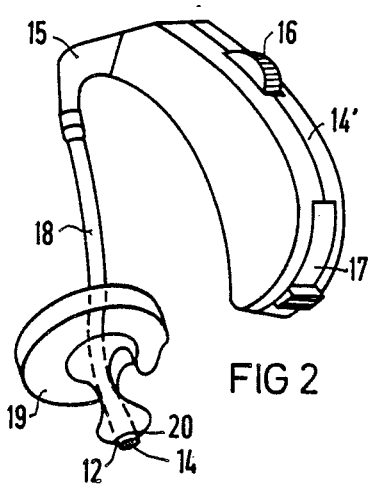
FIG. 2 is a perspective view of a behind-the-ear hearing aid having an ear adaptor which utilizes the present invention.

The present invention is also particularly useful when embodied into a behind-the-ear hearing aid comprising a housing 14' (FIG. 2) that can be secured behind the ear with a carrying hook 15. The housing 14' has a rotary knob 16 for volume adjustment and also is illustrated as having a cover 17 for a battery compartment that can be swivelled out of the housing. The carrying hook 15 is connected to an ear adaptor 19 via a sound hose 18. A cap 12 of the present invention is, again, seated on its outer exit opening 20 of the adaptor 19.

Figure 3:
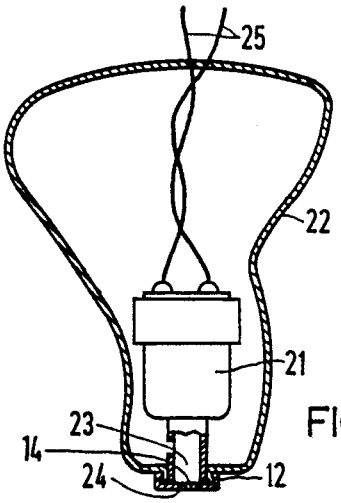
FIG. 3 is a cross sectional view with portions in elevational for purposes of illustration of a separate earphone for a behind-the-ear or pocket-type hearing aid utilizing the present invention.

The present invention is also useful in a separate earphone 21, which is mounted in the housing 22 (FIG. 3) that can be introduced into the auditory canal. The output of the dislocated or separate earphone 21 is connected to the sound exit nozzle 23, whose opening 24 is, in turn, covered by a cap 12 of the present invention. Electrical connecting lines 25 extend' from the housing of the earphone 21, either to a behind-the-ear hearing aid or to a hearing aid which is received in a pocket of the user.

Figure 12:
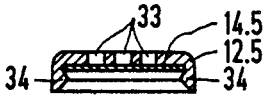
Figure 14:
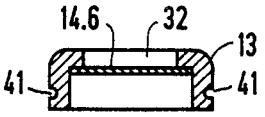
Figure 13:
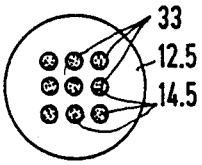
Figure 15:
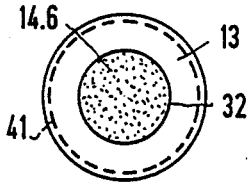

Of the six embodiments of the caps illustrated in FIGS. 4–15, the first four embodiments of FIGS. 4–11 are adapted to be screwed onto the sound exit nozzle. The fifth embodiment of FIGS. 12 and 13 is arranged to be put in place or snapped on an undercut of a sound exit nozzle, such as disclosed by the two German Gebrauchsmusters No. 84 36 783 and 85 04 765. The sixth embodiment of FIGS. 14 and 15 shows an arrangement for a cap 13 for insertion into a sound entry opening for the microphone on a face cover 3 of a hearing aid of FIG. 1. A seventh embodiment of FIGS. 16 and 17 finally shows a corresponding arrangement wherein a cap 30 of the invention can be snapped onto an undercut and the cap 30 also, simultaneously, protects both a sound exit nozzle 35 and an aeration bore or opening 36.

As illustrated in FIGS. 4–11, each of the caps 12.1, 12.2, 12.3 and 12.4 have internal threads 31. The caps 12.1, 12.2, and 12.3 of FIGS. 4–9 also have a single central opening 32 on an end face of the cap. In addition, the cap 13 of FIGS. 14 and 15 also has a single central opening 32. The caps 12.4 and 12.5 of FIGS. 10–13 have a plurality of individual small openings 33 which are illustrated as being in two different patterns, with the pattern of openings of the cap 12.5 of FIG. 13 all having the same size openings, while the pattern of FIG. 11 for the cap 12.4 has two different size openings 33. The cap 12.5 of FIG. 12 does not have inside threads but is provided with a round annular bead 34 that will fit onto a respective undercut of the sound exit nozzle of the respective hearing aid or ear adaptor. In the embodiment illustrated in FIGS. 16 and 17, the sound exit nozzle 35 and an aeration bore 36 are surrounded by an annular bead or undercut 39. A cap 30, which has a group of holes 37 for covering the sound exit nozzle 35 and a group of holes 38 for the aeration pore 36, is provided with an annular bead 40 for engaging the undercut 39. The cap 13 of FIGS. 14 and 15 has an outer annular groove 41 which will engage in the opening edge upon introduction of the cap into a sound entry opening, such as the opening 11 of FIG. 1.

In each of the above arrangements or embodiments of the cap, a micro-porous polytetrafluorethylene membrane 14 obtainable under the Trademark "GORE-TEX" is utilized. Individual membranes are identified as 14.1–14.7 for each of the seven embodiments.

Figure 4:
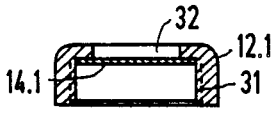
FIGS 4–15 are various views of six modifications of a cap employing the present invention, with FIG. 4 being a cross sectional view of a first embodiment, FIG. 5 being a plan view of the first embodiment, FIG. 6 being a cross sectional view of a second embodiment, FIG. 7 being a plan view of the second embodiment, FIG. 8 being a cross sectional view of a third embodiment, FIG. 9 being a plan view of a third embodiment, FIG. 10 being a cross sectional view of a fourth embodiment, FIG. 11 being a plan view of the fourth embodiment, FIG. 12 being a cross sectional view of a fifth embodiment, FIG. 13 being a plan view of the fifth embodiment, FIG. 14 being a cross sectional view of a sixth embodiment, and FIG. 15 being a plan view of the sixth embodiment.
Figure 6:
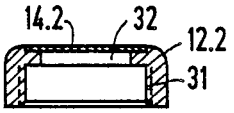
Figure 5:
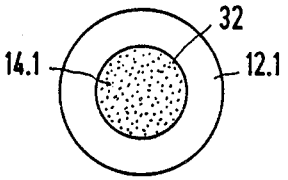
Figure 7:
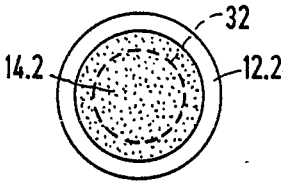

In the first embodiment of FIGS. 4 and 5, the membrane 14.1 is inserted or secured on the interior of the cap 12.1, as illustrated. The difference between the first embodiment and the second embodiment is that the membrane 14.2 of the second embodiment of FIGS. 6 and 7 is secured on the end face of the cap 12.2, as illustrated.

Figure 16:
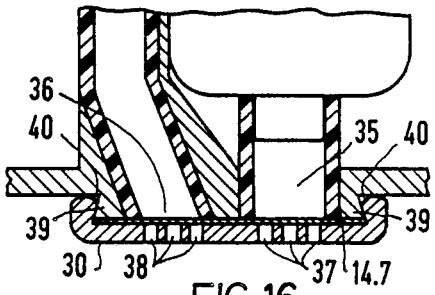
FIG. 16 is a cross sectional view of a portion of a hearing aid having a sound opening and an aeration opening simultaneously closed by a cap member.
Figure 17:
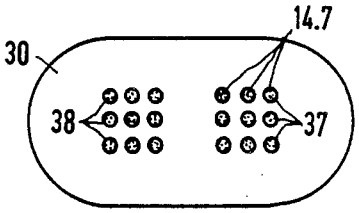
FIG. 17 is a plan view of the cap member of FIG. 16.
Figure 8:
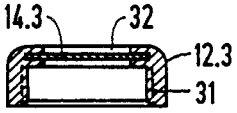
Figure 10:
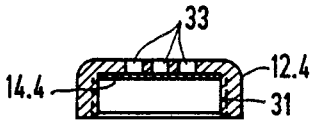
Figure 9:
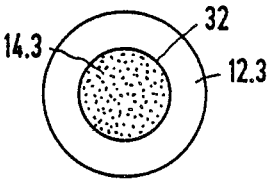
Figure 11:
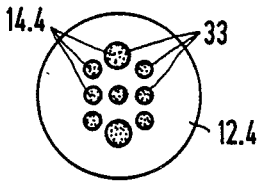

In the third embodiment of FIGS. 8 and 9, a membrane 14.3 is received in a groove in the opening 32, such as being molded in place in the cap 12.3. In the embodiments illustrated by the caps 12.4 and 12.5, the membrane 14.4 and 14.5, respectively, are secured on each of the caps in a fashion similar to the arrangement of the first embodiment of FIGS. 4 and 5. This is also true with the sixth embodiment which has a membrane 14.6 secured on the interior of the cap 13. In addition, the membrane 14.7 of the cap 30 is secured on the interior of the cap, as illustrated in FIG. 16.

As already previously described, the membrane 14 respectively provides a good sound transmissivity but, nonetheless, protects the respectively utilized hearing aid against the penetration both of earwax as well as moisture, particularly sweat, from the auditory canal. Since the sweat is kept away, sensitive component parts of the hearing aid are not exposed to the risk of damage due to corrosion or the like. As experience has shown, the utilized membrane material is water-tight up to 0.65 bar and can, thus, also be cleaned in an ultrasonic bath as needed without the sensitive electronic component parts of the hearing aid, particularly the earphone, being damaged. It is, thus, no longer required to completely replace the cap, as hereinbefore. The cerumen-contaminated cap can, thus, remain on the hearing aid. It is merely necessary to partially immerse the hearing aid or the ear adaptor that, of course, is made water-tight by the utilization of the membrane of the present invention into an ultrasound bath and to clean the membrane of the earwax. After cleaning the respective hearing aid with the cap still screwed on it again available in a functional fashion and optimally cleaned without further manipulations.

Although various minor modifications may be suggested by those versed in the art, it should be understood that I wish to embody within the scope of the patent granted hereon all such modifications as reasonably and properly come within the scope of my contribution to the art.

I claim:

1. An apparatus for closing openings in a housing of hearing aids and parts of hearing aids, said openings being selected from a group consisting of sound entry, sound exit and aeration openings, said apparatus comprising a cap being mounted on the housing to close the opening, said cap having an opening for the transmission of sound and air through the cap, said cap having means for preventing moisture, sweat and cerumen from passing through said opening in the cap, said means being a microporous membrane of a hydrophobic material extending across the opening of the cap, said material of the membrane being a microporous polytetraflourethylene.

2. An apparatus according to claim 1, wherein the membrane is an integral part of the cap.

3. An apparatus according to claim 1, wherein the membrane is at least partially molded into the cap.

4. An apparatus according to claim 1, wherein the membrane is separate from the cap and is placed between the cap and the opening of the housing before the cap is attached to the housing.

* * * * *

UNITED STATES PATENT AND TRADEMARK OFFICE

CERTIFICATE OF CORRECTION

PATENT NO. : 4,987,597

DATED : January 22, 1991

INVENTOR(S) : Christof Haertl

It is certified that error appears in the above—identified patent and that said Letters Patent is hereby corrected as shown below:

ON TITLE PAGE:

Please correct the title to read:

--APPARATUS FOR CLOSING OPENINGS OF A HEARING AID OR AN EAR ADAPTOR FOR HEARING AIDS"--

Signed and Sealed this

Twenty-third Day of June, 1992

*Attest:*

*Attesting Officer*

DOUGLAS B. COMER

*Acting Commissioner of Patents and Trademarks*